US005907878A

United States Patent [19]

Thomas et al.

[11] Patent Number: 5,907,878

[45] Date of Patent: Jun. 1, 1999

[54] AIR SPRING BEDDING SYSTEM

[76] Inventors: Paul B. Thomas, 1257 W. O'Farrell St., San Pedro, Calif. 90731; Robert Leventhal, 2548 Micheltorena, Los Angeles, Calif. 90039

[21] Appl. No.: 08/948,763

[22] Filed: Oct. 10, 1997

[51] Int. Cl.[6] ..... A47C 27/10

[52] U.S. Cl. ..... 5/710; 5/706

[58] Field of Search ..... 5/710, 706, 713

[56] References Cited

U.S. PATENT DOCUMENTS

| | | | |
|---|---|---|---|
| 3,879,776 | 4/1996 | Solen . | |
| 4,005,236 | 1/1977 | Graebe . | |
| 4,120,061 | 10/1978 | Clark | 5/710 |
| 4,454,615 | 6/1984 | Whitney | 5/498 |
| 4,629,253 | 12/1986 | Williams | 297/452 |
| 4,631,767 | 12/1986 | Carr et al. . | |
| 4,827,546 | 5/1989 | Cvetkovic | 5/267 |
| 4,852,195 | 8/1989 | Schulman | 5/710 |
| 4,895,352 | 1/1990 | Stumpf | 5/246 |
| 4,967,431 | 11/1990 | Hargest et al. | 5/689 |
| 5,097,552 | 3/1992 | Viesturs | 5/496 |
| 5,680,662 | 10/1997 | Purdy et al. | 5/710 |

*Primary Examiner*—Alex Grosz

*Attorney, Agent, or Firm*—Thomas I. Rozsa; Tony D. Chen; Jerry Fong

[57] ABSTRACT

An air spring bedding system includes a mattress matrix assembly and a box spring assembly. The mattress matrix assembly comprises first and second air support structures. Each support structure has alternating offset air springs and connecting tubes which interconnect to two adjacent alternating offset air springs for distributing air between them. One of the two support structures also has alternating offset apertures. A respective one of the alternating air springs of the second support structure are respectively aligned with and inserted into a respective one of the alternating offset apertures of the first support structure such that the two support structures abut against each other to form the mattress matrix assembly. The alternating air springs of the two support structures are arranged in a matrix arrangement. The box spring assembly includes upper and lower support structures. Each support structure has a plenum and hollow cylinders which are arranged in a matrix arrangement. The hollow cylinders of the upper and lower support structures are offset from one another. The hollow cylinders of the upper support structure are respectively inserted in-between the hollow cylinders of the lower support structure such that the hollow cylinders of the upper and lower support structures are located adjacent to one another, and thereby form the box spring assembly.

32 Claims, 12 Drawing Sheets

AIR SPRING BEDDING SYSTEM

BACKGROUND OF THE INVENTION

1. Field of the Invention

The present invention generally relates to the field of bed systems. More particularly, the present invention relates to the field of adjustable air mattresses for beds.

2. Description of the Prior Art

Air bed systems are well known in the art. Many of the prior art air bed systems include an air mattress and a box spring. The prior art air mattress construction have problems which can cause discomfort and disruption to the sleeping process. One of the prior art mattresses is a conventional air mattress which comprises simply a flexible enclosure filled with air. When depressed, the enclosure depresses slightly in the vicinity of the loading and also increases pressure in the remaining volume of the enclosure. The response is both resistive and bouncy, which are undesirable characteristics as far as the comfort of the user is concerned.

The following ten (10) prior art patents are found to be pertinent to the field of the present invention:

1. U.S. Pat. No. 3,879,776 issued to Solen on Apr. 29, 1996 for "Variable Tension Fluid Mattress" (hereafter the "Solen Patent");

2. U.S. Pat. No. 4,005,236 issued to Graebe on Jan. 25, 1977 for "Expandable Multicelled Cushioning Structure" (hereafter the "Graebe Patent");

3. U.S. Pat. No. 4,120,061 issued to Clark on Oct. 17, 1978 for "Pneumatic Mattress With Valved Cylinders Of Variable Diameter" (hereafter the "Clark Patent");

4. U.S. Pat. No. 4,454,615 issued to Whitney on Jun. 19, 1984 for "Air Pad With Integral Securement Straps" (hereafter the "Whitney Patent");

5. U.S. Pat. No. 4,629,253 issued to Williams on Dec. 16, 1986 for "Seat Occupant-Activated Underseat Support Air-Cushion" (hereafter the "Williams Patent");

6. U.S. Pat. No. 4,631,767 issued to Carr et al. on Dec. 30, 1986 for "Air Flotation Mattress" (hereafter the "Carr Patent");

7. U.S. Pat. No. 4,827,546 issued to Cvetkovic on May 9, 1989 for "Fluid Mattress" (hereafter the "Cvetkovic Patent");

8. U.S. Pat. No. 4,895,352 issued to Stumpf on Jan. 23, 1990 for "Mattress Or Cushion Spring Array" (hereafter the "Stumpf Patent");

9. U.S. Pat. No. 4,967,431 issued to Hargest et al. on Nov. 6, 1990 for "Fluidized Bed With Modular Fluidizable Portion" (hereafter the "Hargest Patent"); and 10. U.S. Pat. No. 5,097,552 issued to Viesturs on Mar. 24, 1992 for "Inflatable Air Mattress With Straps To Attach It To A Conventional Mattress" (hereafter the "Viesturs Patent").

The Solen Patent discloses a variable tension fluid mattress. It comprises a fluid chamber defined by an upper wall and a bottom wall which form a base. The fluid chamber can be compartmentalized by a longitudinal divider and cross dividers to provide individual zones of the fluid chamber. A plurality of pressure expandable pads are clamped to the upper wall by a disc which is secured to a hollow stem which communicates with the fluid chamber. A restraining chain is mounted within each pad and merely serves to limit the upward expansion of the pad regardless of the internal pressure.

The Graebe Patent discloses an expandable multicelled cushioning structure. It comprises a common base and a plurality of cells which are attached to the base, and are initially in a configuration so that the cells when formed are spaced apart but when later expanded by a pressurized fluid, will contact or be closely spaced to one another at their sidewalls.

The Clark Patent discloses a pneumatic mattress with valved cylinders of variable diameter. It comprises a plurality of valved cylinder cells held by a cover in a side-by-side relationship. Each cell comprises upper and lower cylindrical sections of equal diameter interconnected by a corrugated cylindrical section which has a smaller diameter. Each lower cylindrical section has an orifice which connects the interior of the cell with an air plenum that extends along the entire underside of the mattress. Each orifice registers with a valve that projects from the inner surface of the plenum opposite the cell orifice and is supported by a small, collapsible section of the cell in a normally open position, so that when a load is applied to the top of the cell it automatically closes the orifice against the registering valve.

The Whitney Patent discloses an air pad with integral securement straps. It comprises an upper layer and a lower layer which are joined together at a heat seal extending around the entire periphery of the pad. The pad is filled with air, water, a gel or the like. Securement straps are provided on the pad and fitted around and under the corners of a standard bed mattress to hold the pad in position on the mattress.

The Williams Patent discloses a seat occupant-activated underseat support air-cushion. It comprises a support base and an airtight expandable air cushion which rests on the support base. The top of the air-cushion is pressed upward against the bottom side of the vehicle seat cushion. A bellows type air pump is disposed within the air cushion and provides an outside air-intake.

The Carr Patent discloses an air flotation mattress. It comprises a lower inflatable chamber with a series of side-by-side air supply channels and an air-pervious upper wall. An inflatable compartment is overlaid on the chamber and forms a secondary air-pervious wall. A fan assembly is operatively coupled with the lower inflatable chamber to supply pressurized air.

The Cvetkovic Patent discloses a fluid mattress. It comprises side frames, a bottom support, and flexible and contractible bellows distributed over the bottom support. Connecting tubings are connected from the bellows to adjacent bellows to permit fluid flow therebetween. A top cover is extended over the bellows. Coil springs are mounted on top of the bellows to support the top cover.

The Stumpf Patent discloses a mattress or cushion spring array. It comprises a plurality of spring units. Each spring unit has a body, a top deformable end, and a bottom deformable end, where the ends are free for axial compression. The spring units are interconnected together by connecting fins which extend from the body of each spring unit.

The Hargest Patent discloses a fluidized bed with a modular fluidizable portion. A plurality of fluidizable cells are disposed and attached atop of an air permeable support. Each cell contains a discrete mass of fluidizable material which can be manually detachable and removable from the support for ease of cleaning and replacement.

The Viesturs Patent discloses an inflatable air mattress with straps to attach it to a conventional mattress. It comprises an upper air impervious flexible layer and a lower air impervious flexible layer. The peripheries of the first and second layers are joined together in an air impervious sealed relationship.

None of these prior art patents teach an air spring bedding system, resting or therapeutic structure to provide a matrix surface that is both supportive and pliable with minimal surface tension. It is desirable to have a very efficient and also very effective design and construction of an air spring bedding system for providing comfort and tranquillity to a user during his or her sleep by two different air support structures to create a matrix surface that is both supportive and pliable with minimal surface tension.

SUMMARY OF THE INVENTION

The present invention is a novel and unique air spring bedding system. It comprises a mattress matrix assembly and a box spring assembly. The mattress matrix assembly comprises first and second air support structures. The first air support structure comprises a base, a plurality of spaced apart alternating offset compressible and expandable members extending upwardly from the base, a plurality of alternating offset apertures respectively located adjacent to the plurality of alternating offset compressible and expandable members, and a plurality of connecting members formed with the base and interconnected to a pair of adjacent alternating offset compressible and expandable members for distributing air between the other compressible and expandable members.

The second air support structure comprises a base, a plurality of alternating offset compressible and expandable members, and a plurality of connecting members formed with the base and interconnected to a pair of adjacent alternating offset compressible and expandable members for distributing air between the other compressible and expandable members. The compressible and expandable members are respectively aligned with the plurality of apertures of the first air support structure. The second air support structure is assembled below the first air support structure such that the compressible and expandable members of the second air support structure are respectively inserted into the apertures of the first air support structure, where the base of the first air support structure abuts against the base of the second air support structure, and the compressible and expandable members of the first and second air support structures are arranged in a matrix arrangement (rows and columns).

In addition, the air spring bedding system further comprises means for supplying air under pressure to inflate the compressible and expandable members of the first and second support structures to a desired stiffness, such that the compressible and expandable members of the first and second air support structures are relatively close together and air is respectively transferrable from the compressible and expandable members by the respective connecting members of the first and second air support structures.

The box spring assembly includes upper and lower air-tight support structures. The upper support structure has an upper plenum and a plurality of spaced apart vertical hollow cylinders which extend downwardly from and communicate with the upper plenum. These hollow cylinders are arranged in a matrix arrangement (rows and columns). The lower support structure has a lower plenum and a plurality of spaced apart vertical hollow cylinders which extend upwardly from and communicate with the lower plenum. These hollow cylinders of the lower support structure are also arranged in a matrix arrangement (rows and column) which are offset from the cylinders of the upper support structure.

The hollow cylinders of the upper support structure are respectively inserted in between the hollow cylinders of the lower support structure such that the hollow cylinders of the upper and lower support structures are respectively located adjacent to one another. In addition, the upper and lower support structures further include means for supplying air under pressure to the interiors of the upper and lower support structures.

It is therefore an object of the present invention to provide a new and improved type of air spring bedding system wherein the construction of a bedding provides a resting or therapeutic structure formed by mushroom shaped air springs to create a matrix surface that is both supportive and pliable with minimal surface tension. Pressure exerted upwardly against the weight of a resting body by the first air support structure can be adjusted to be less than or greater than the pressure exerted upwardly by the second air support structure. The difference in pressure between the first and second air support structures creates portions of the mattress matrix assembly that are pliable with minimal surface tension between supportive portions. The stress produced is reduced because the pliable portions can conform to the complex curves of the human form and thus increase the area supported. Stress concentrations are reduced due to the increase in area supported, overall reduction in supportive pressures and minimized surface tension.

It is a further object of the present invention to provide a new and improved type of air spring bedding system so additional comfort is created by the mattress matrix assembly's ability to adjust the relative pressure over a large range to suit the various shapes and masses of resting bodies. The mushroom shaped air springs can be further customized to suit individuals by utilizing zoned construction fostered by both its fluid system and matrix design. Also inherent in the basic design is the ability to dynamically adapt to a variety of changing resting positions by the proper sizing of the same interconnection of the mushroom shaped air springs required for pressurization of a zone or the entire structure.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an air spring bedding system. The concept of the present invention is the construction of a bedding, resting or therapeutic structure by two different air support structures to create a matrix surface that is both supportive and pliable with minimal surface tension.

Figure 1:
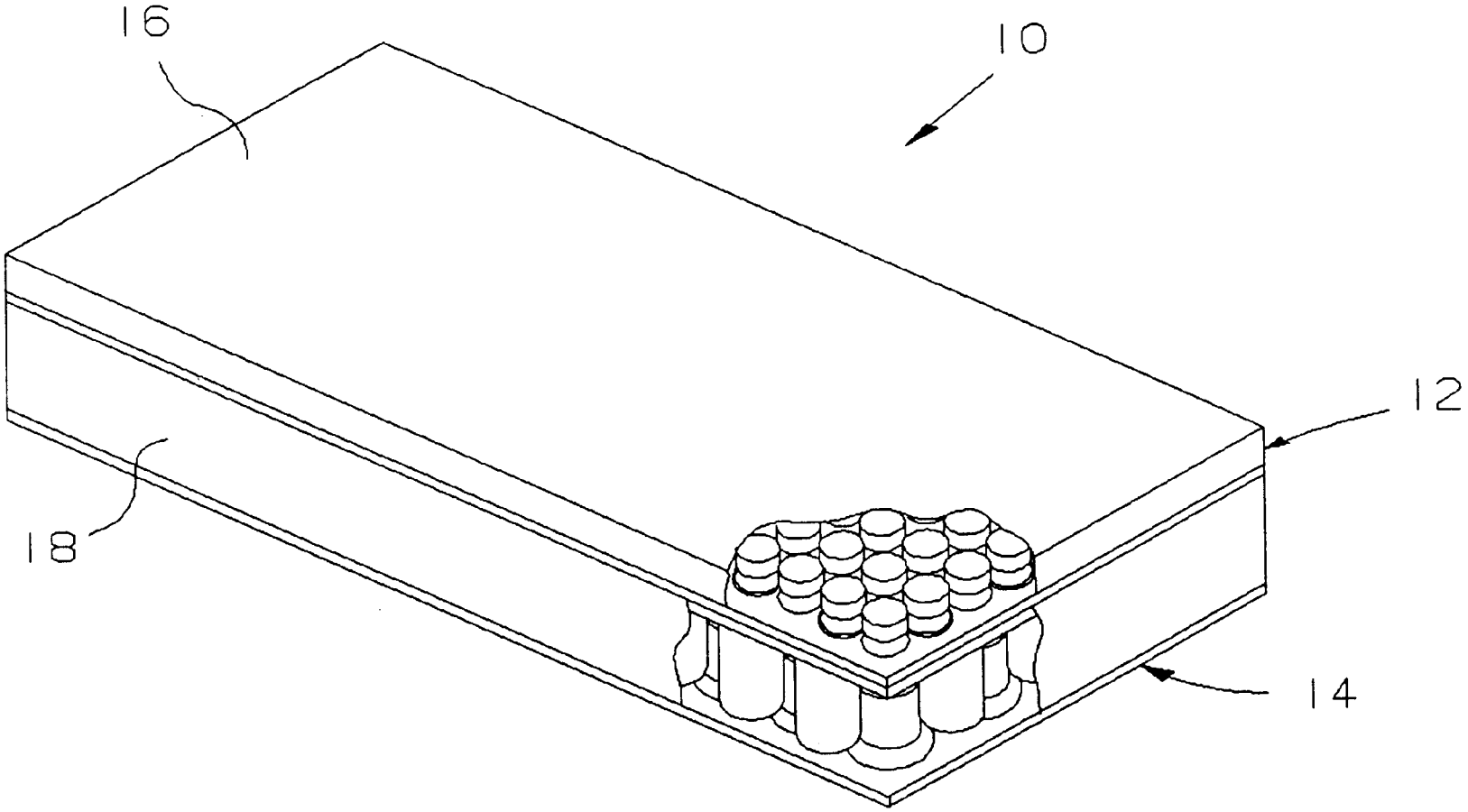
FIG. 1 is a partial cutout perspective view of the present invention air spring bedding system, showing a mattress matrix assembly and a box spring assembly.

Referring to FIG. 1, there is shown at 10 a preferred embodiment of the present invention air spring bedding system. The bedding system 10 comprises a mattress matrix assembly 12 and a box spring assembly 14. It may also include a cushion layer (not shown). The mattress matrix assembly 12 may be manufactured with a mattress cover 16 for covering the entire surface of the mattress matrix assembly 12. The box spring assembly 14 may also be manufactured with a box spring cover 18 for covering the entire surface of the box spring assembly 14.

Figure 2:
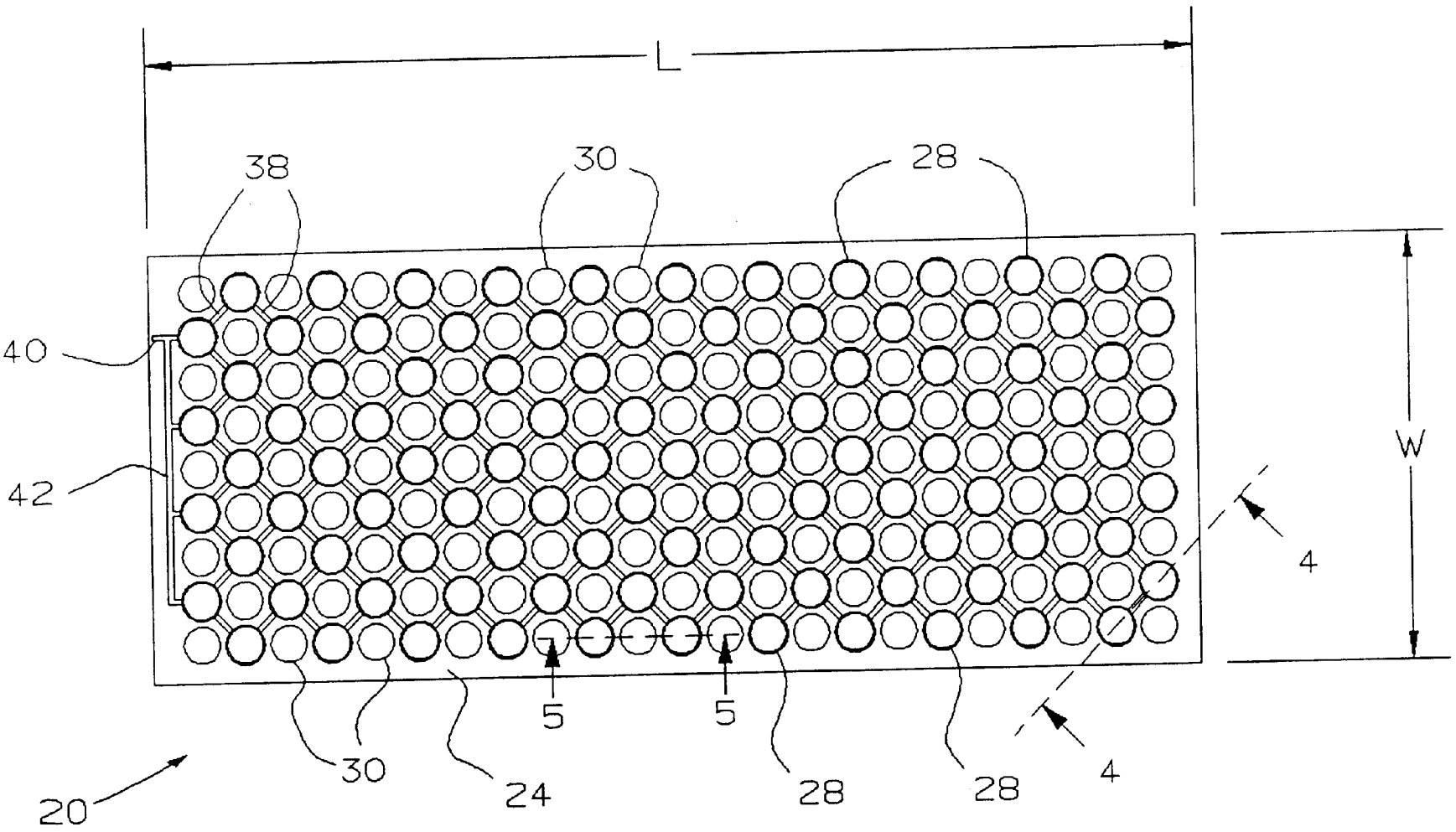
FIG. 2 is a top plan view of a first air support structure with a plurality of compressible and expandable members.
Figure 6:
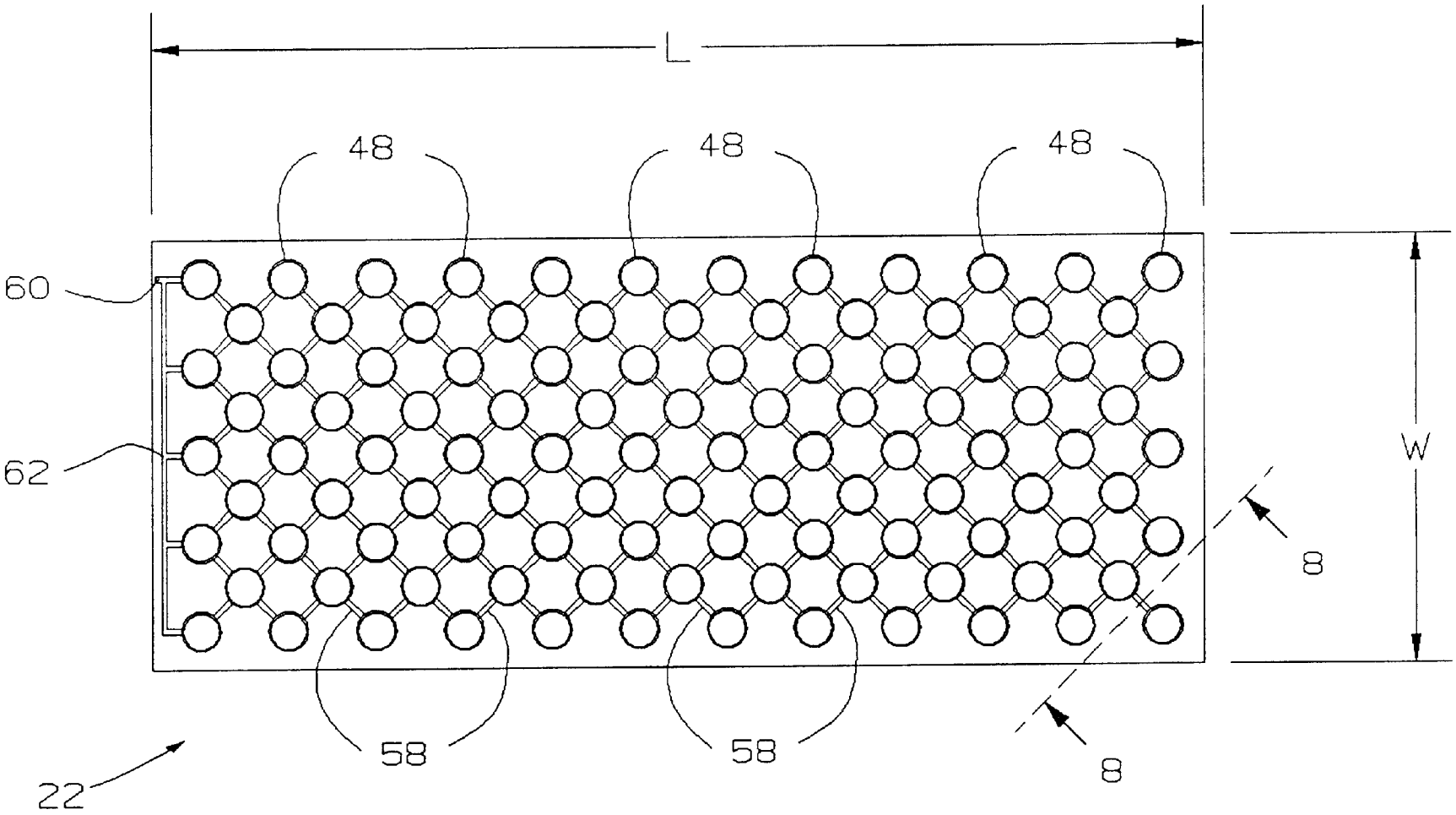
FIG. 6 is a top plan view of a second air support structure with also a plurality of compressible and expandable members.

Referring to FIGS. 1, 2 and 6, the mattress matrix assembly 12 includes a first air support structure 20 and a second air support structure 22, and both structures are airtight and fluid-tight and are generally rectangular shaped. By way of example, the overall length "L" and width "W" of both of the air support structures 20 and 22 are approximately 72.25 inches by 29.25 inches respectively. It will be appreciated that the dimensions described above are merely one illustrative embodiment, and it is within the spirit and scope of the present invention to include many other comparable sets of dimensions.

Figure 3:
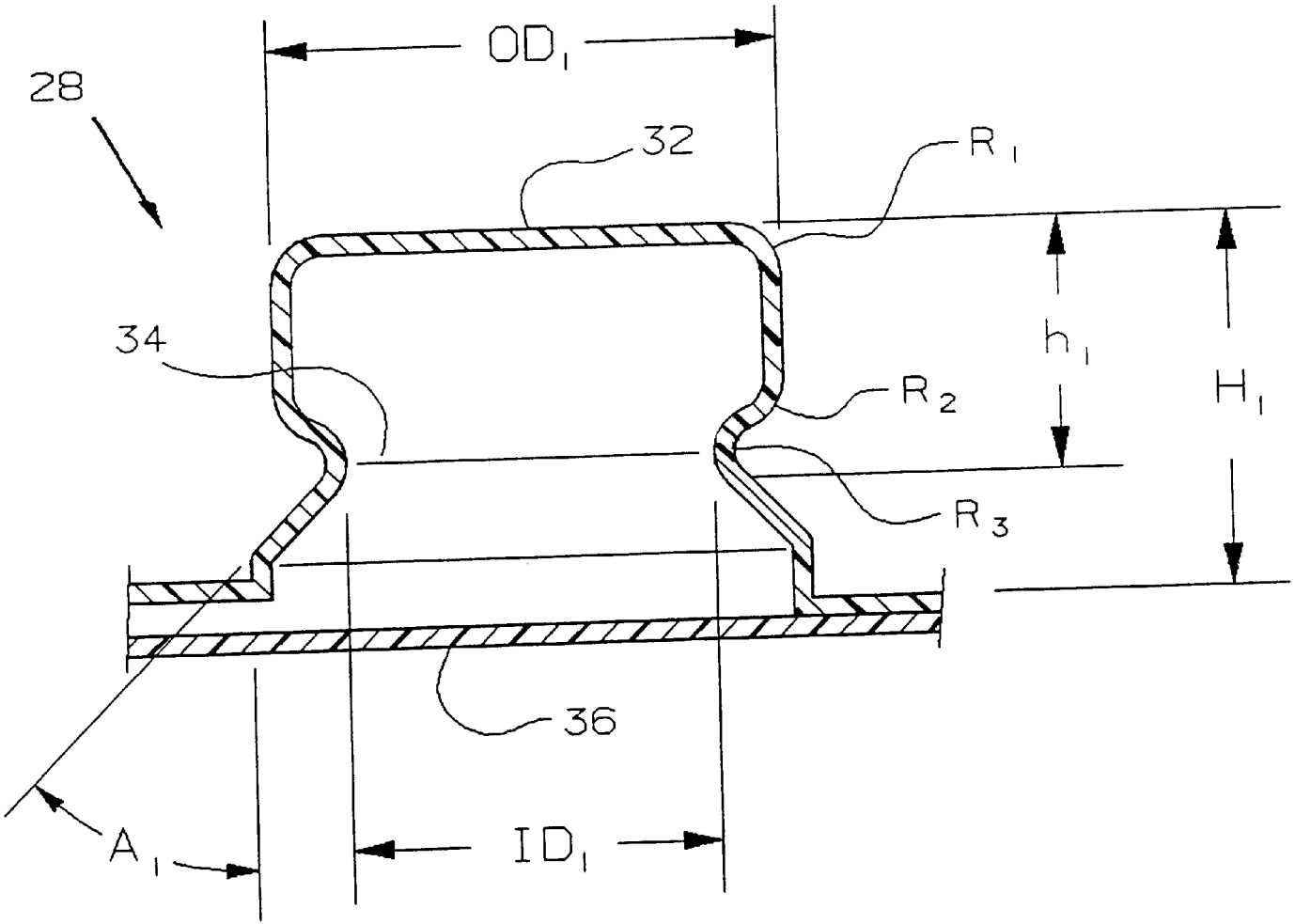
FIG. 3 is a side elevational view of one of the plurality of compressible and expandable members shown in FIG. 2.
Figure 4:
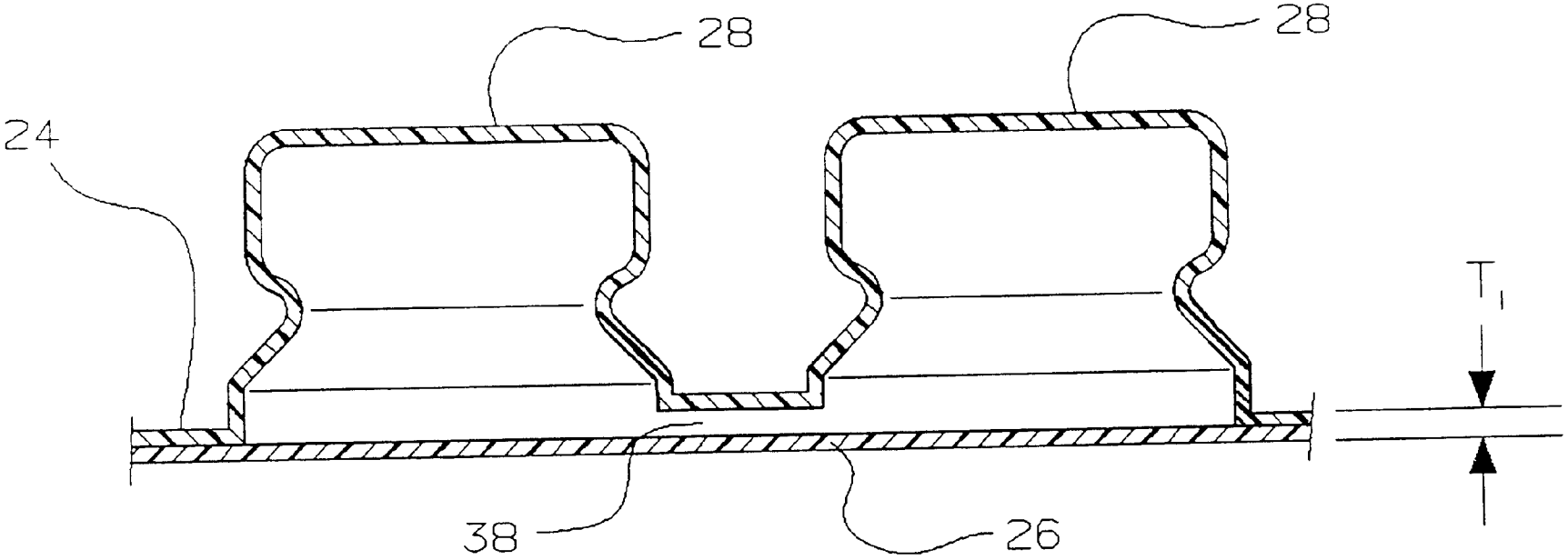
FIG. 4 is a cross-sectional view taken along line 4—4 of FIG. 2.

Referring to FIGS. 2, 3 and 4, the first air support structure 20 is constructed by a flexible top layer 24 and a flexible bottom layer 26 permanently affixed to the top layer 24 by ultrasonic welding, radio frequency (RF) and heat welding or other suitable means to form a plurality of spaced apart vertical adjustable hollow mushroom shaped air springs or compressible and expandable members 28. The top and bottom layers 24 and 26 form a base portion, where the adjustable hollow mushroom shaped air springs 28 extend upwardly therefrom. By way of example, the thickness "$T_1$" of the two layers 24 and 26 when combined is approximately 0.25 inch. The hollow air springs 28 are arranged in an alternating offset arrangement from one another (see FIG. 2). A plurality of circular shaped apertures 30 are provided with the first air support structure 20. These apertures 30 are also arranged in an alternating offset arrangement from one another. The apertures 30 may be stamped out from the two layers 24 and 26, cut out or may be removed by any suitable means known to one skilled in the art. These apertures 30 are substantially identical in size.

Referring to FIGS. 3 and 4, the plurality of hollow air springs 28 are substantially identical, and to the extent they are, only one will be described in detail below. Each hollow air spring 28 has a wide closed distal end 32, a narrow middle 34, and a wide open proximal end 36. The wide proximal end 36 is integrally formed with the top layer 29 of the first air support structure 20 such that the hollow air spring 28 is compressible and expandable when a downward pressure is applied. By way of example, the overall height "$H_1$" of the hollow air spring 28 is approximately 1.66 inches, while the height "$h_1$" which is the distance between the top of the wide closed distal end 32 to the narrow middle 34 is approximately 1.10 inches. The hollow air spring 28 has two different diameters, the outer diameter "$OD_1$" which is the wide distal and proximal ends 32 and 36, and the inner diameter "$ID_1$" which is the narrow middle part 34. By way of example, the "$OD_1$" is approximately in a range of 3.50–3.70 inches, while the "$ID_1$" is approximately 2.00 inches. In addition, the hollow air spring 28 is made with several curved surfaces $R_1$, $R_2$ and $R_3$. By way of example, $R_1$. and $R_2$ are approximately 0.25 inch, while $R_3$ is approximately 0.13 inch. By way of example, the hollow air spring 28 has an angle "$A_1$", where "$A_1$" is approximately a 45° angle. By way of example, two adjacent hollow air springs 28 which are in the same row or column are spaced apart from one another approximately 6.00 inches from center to center (see FIG. 2). By way of example, two adjacent hollow air springs 28 which are not in the same row or column are spaced apart from one another approximately 3.00 inches from center to center (see FIG. 2).

Referring to FIGS. 2 and 4, there is shown a first group of a plurality of connecting tubes or members 38 which are substantially identical, and to the extent they are, only one will be described in detail. Each connecting tube 38 is integrally formed with the top layer 24 of the first air support structure 20, where each connecting tube 38 is respectively interconnected to two adjacent air springs 28 for allowing air to flow between the plurality of spaced apart vertical hollow mushroom shaped air springs 28.

The first air support structure 20 is also provided with a main inlet port 40 which is connected to an air supply line 42 which in turn connects to specified air springs 28 for supplying air under pressure to the other vertical hollow mushroom shaped air springs 28. The first air support structure 20 may be further customized to suit individuals by utilizing zoned distribution, where the first air support structure 20 may include at least three different zones therein. To fill the first air support structure 20, air, or the like, is adapted to be supplied to the plurality of mushroom shaped air springs 28 by the main inlet port 40 which in turn supplies it to the air supply line 42, which in turn supplies it to the plurality of air springs 28. The main inlet port 40 may have a conventional valve (not shown), which operates in a known manner to control the flow of gas into or out of the plurality of air springs 28 of the first air support structure 20. In the preparation of the first air spring support structure 20 for use, the valve is open, so that any air under pressure is supplied through the main inlet port 40 to the air supply line 42 which in turn supplies the specified air springs 28. The connecting tubes 38 are then supplying the air under pressure to all of the other air springs 28. The mushroom shaped air springs 28 are inflated to a desired stiffness. When the first air support structure 20 has been filled with the desired amount of air, the main inlet port 40 is closed off by a suitable cap (not shown).

Figure 7:
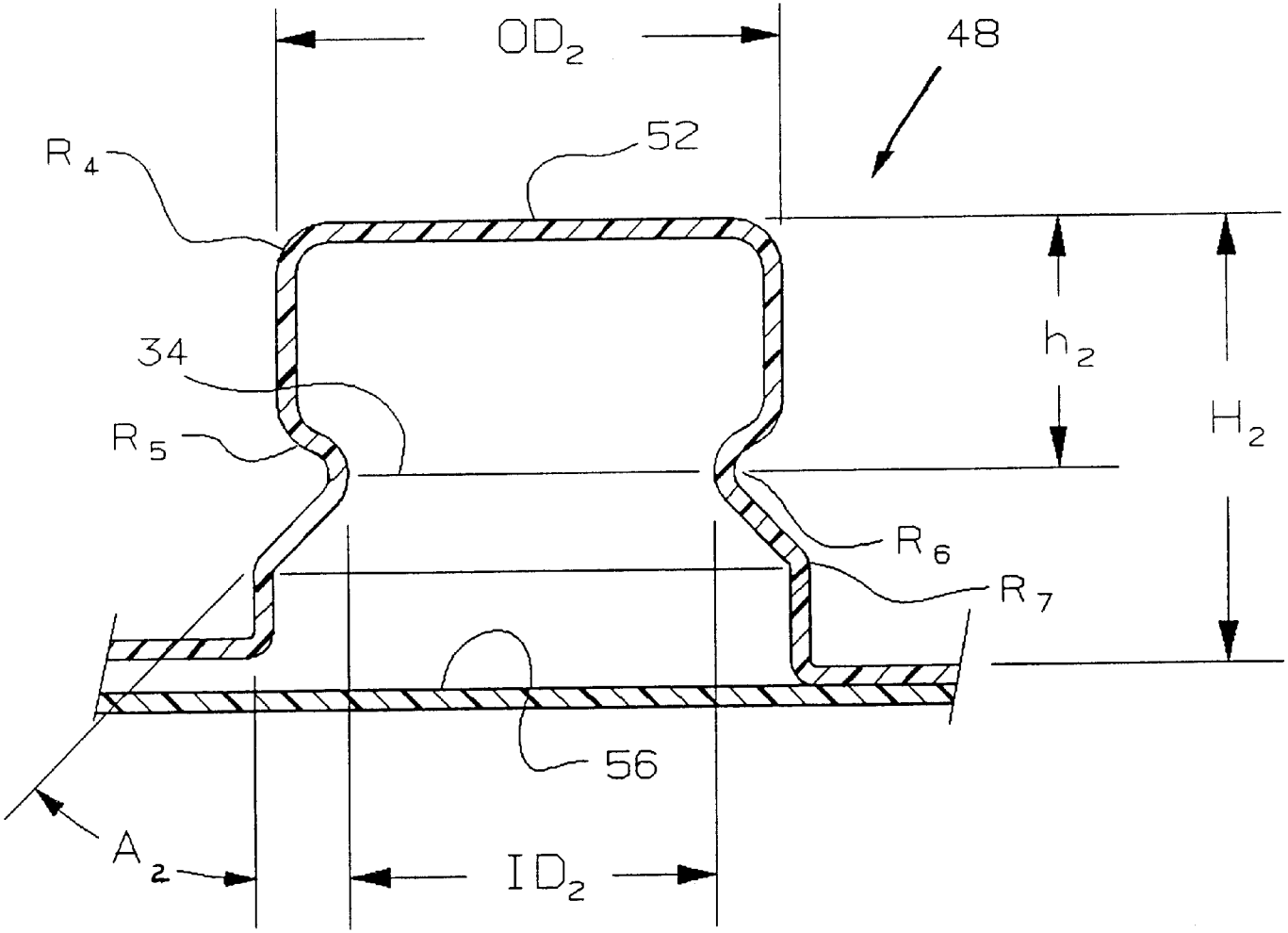
FIG. 7 is a side elevational view of one of the plurality of compressible and expandable members shown in FIG. 6.
Figure 8:
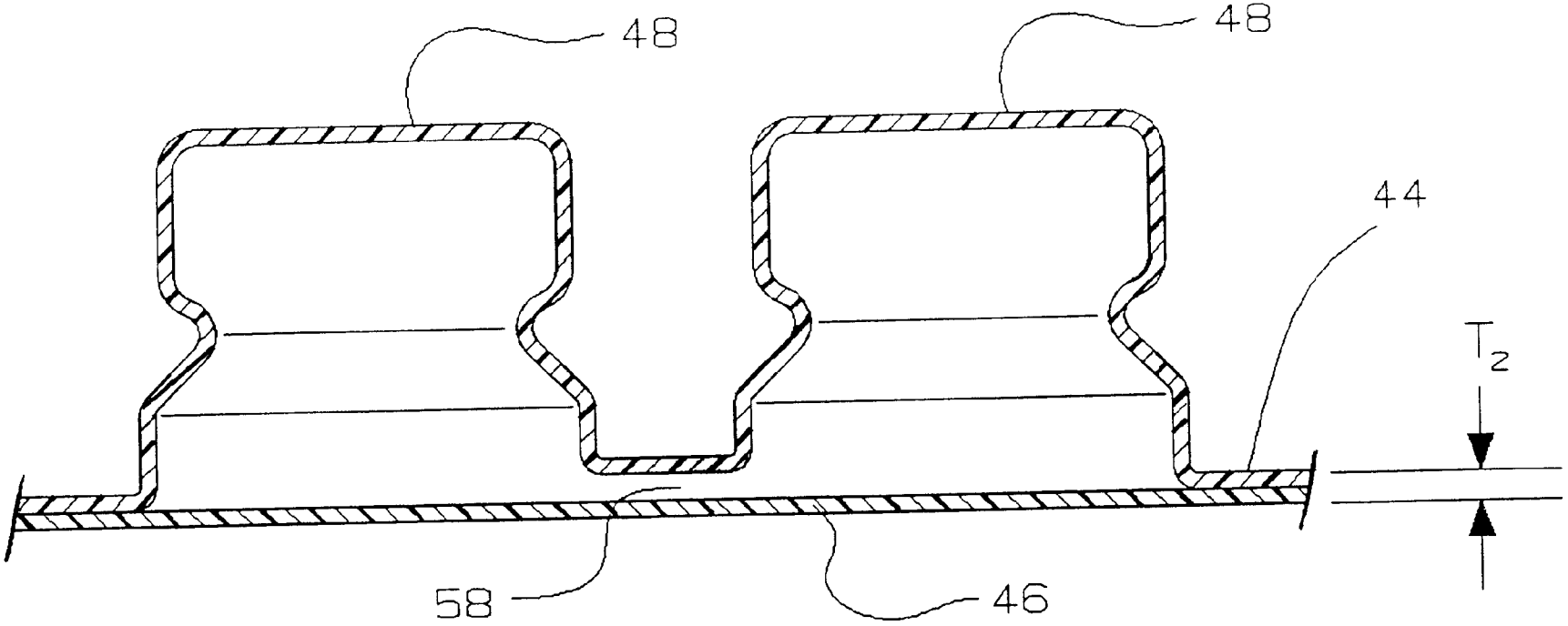
FIG. 8 is a cross-sectional view taken along line 8—8 of FIG. 6.

Referring to FIGS. 6, 7 and 8, the second air support structure 22 is constructed by a flexible top layer 44 and a flexible bottom layer 46 permanently affixed to the top layer 44 by ultrasonic welding, radio frequency (RF) and heat welding or other suitable means to form a plurality of spaced apart vertical adjustable hollow mushroom shaped air springs or compressible and expandable members 48. The two layers 44 and 46 form a base portion, where the vertical adjustable hollow mushroom shaped air springs 48 extend upwardly therefrom. By way of example, the thickness "$T_2$" of the two layers 44 and 46 when combined is approximately 0.25 inch. The plurality of hollow air springs 48 are arranged in an alternating offset arrangement from one another (see FIG. 6).

Referring to FIGS. 7 and 8, the plurality of hollow air springs 48 are substantially identical, and to the extent they are, only one will be described in detail below. Each hollow air spring 48 has a wide closed distal end 52, a narrow middle 54, and a wide open proximal end 56. The wide open proximal end 56 is integrally formed with the top layer 44 of the air support structure 22 such that the hollow air spring 48 is compressible and expandable when a downward pressure is applied. By way of example, the overall height "$H_2$" of the hollow air spring 48 is approximately 2.03 inches, while the height "$h_2$" which is the distance from the top of the wide closed distal end 52 to the narrow middle 44 is approximately 1.23 inches. The hollow air spring 48 has two different diameters, the outer diameter "$OD_2$" which is the wide distal and proximal ends 52 and 56, and the inner diameter "$ID_2$" which is the narrow middle part 54. By way of example, the "$OD_2$" is approximately in a range of 3.50–3.70 inches, while the inner diameter "$ID_2$" is approximately 2.00 inches. In addition, the hollow air spring 48 is made with several curved surfaces $R_4$, $R_5$, $R_6$, and $R_7$. By way example, $R_4$ and $R_5$ are approximately 0.25 inch, $R_6$, is approximately 0.13 inch and $R_7$ is approximately 0.06 inch. By way of example, the hollow air spring 48 has an angle $A_2$ which is a 45° angle. By way of example, two adjacent hollow air springs 48 which are in the same row or column are spaced apart from one another approximately 6.00 inches from center to center (see FIG. 6). By way of example, two adjacent hollow air springs 48 which are not in the same row or column are spaced apart from one another approximately 3.00 inches from center to center (see FIG. 6).

Referring to FIGS. 6 and 8, there is shown a second group of a plurality of connecting tubes or members 58 which are substantially identical, and to the extent they are, only one will be described in detail. Each connecting tube 58 is integrally formed with the top layer 44 of the second air support structure 22, where each connecting tube 58 is respectively interconnected to two adjacent air springs 48 for allowing air to flow between the plurality of spaced apart vertical hollow mushroom shaped air springs 48.

The second air support structure 22 is also provided with a main inlet port 60 which is connected to an air supply line 62 which in turn connects to specified air springs 48 for supplying air under pressure to the other vertical hollow mushroom shaped air springs 48. The second air support structure 22 may be further customized to suit individuals by utilizing zoned distribution, where the second air support structure 22 may include at least three different zones therein. To fill the second air support structure 22, air, or the like, is adapted to be supplied to the plurality of mushroom shaped air springs 48 by the main inlet port 60 which in turn supplies it to the air supply line 62, which in turn supplies it to the plurality of air springs 48. The main inlet port 60 may have a conventional valve (not shown), which operates in a known manner to control the flow of gas into or out of the plurality of air springs 48 of the second air support structure 22. In the preparation of the second air spring structure 22 for use, the valve is open, so that any air under pressure is supplied through the main inlet port 60 to the air supply line 62 which in turn supplies the specified air springs 48. The connecting tubes 58 are then supplying the air under pressure to all of the other air springs 48 of the second air support structure 22. The mushroom shaped air springs 48 are inflated to a desired stiffness. When the second air support structure 40 has been filled with the desired amount of air, the main inlet port 60 is closed off by a suitable cap (not shown).

Figure 5:
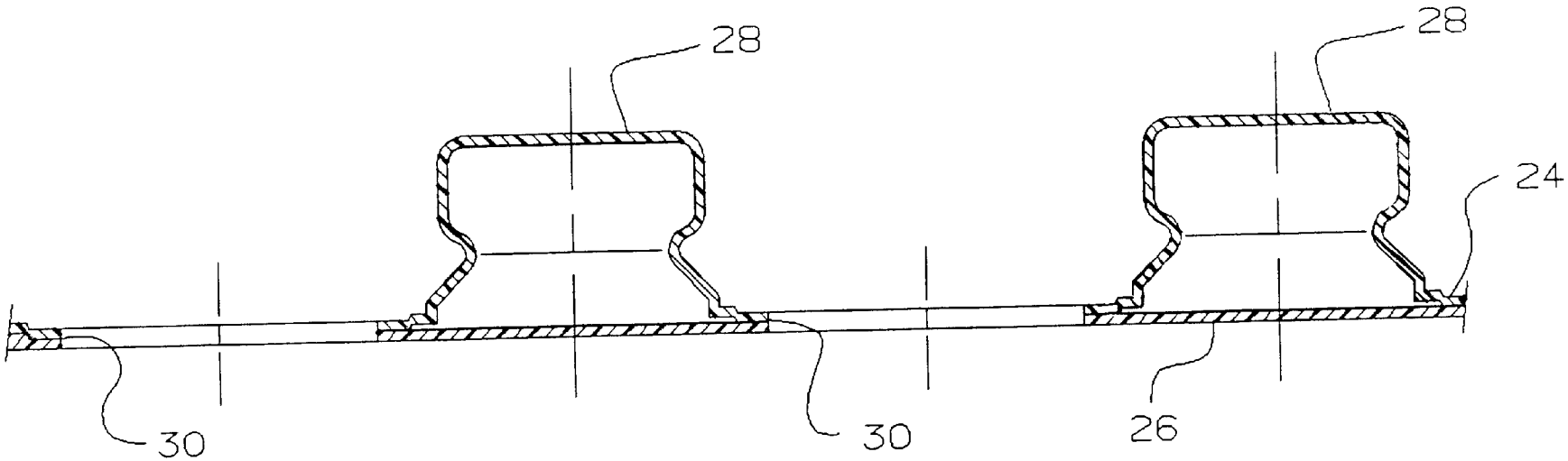
FIG. 5 is a cross-sectional view taken along line 5—5 of FIG. 2.
Figure 9:
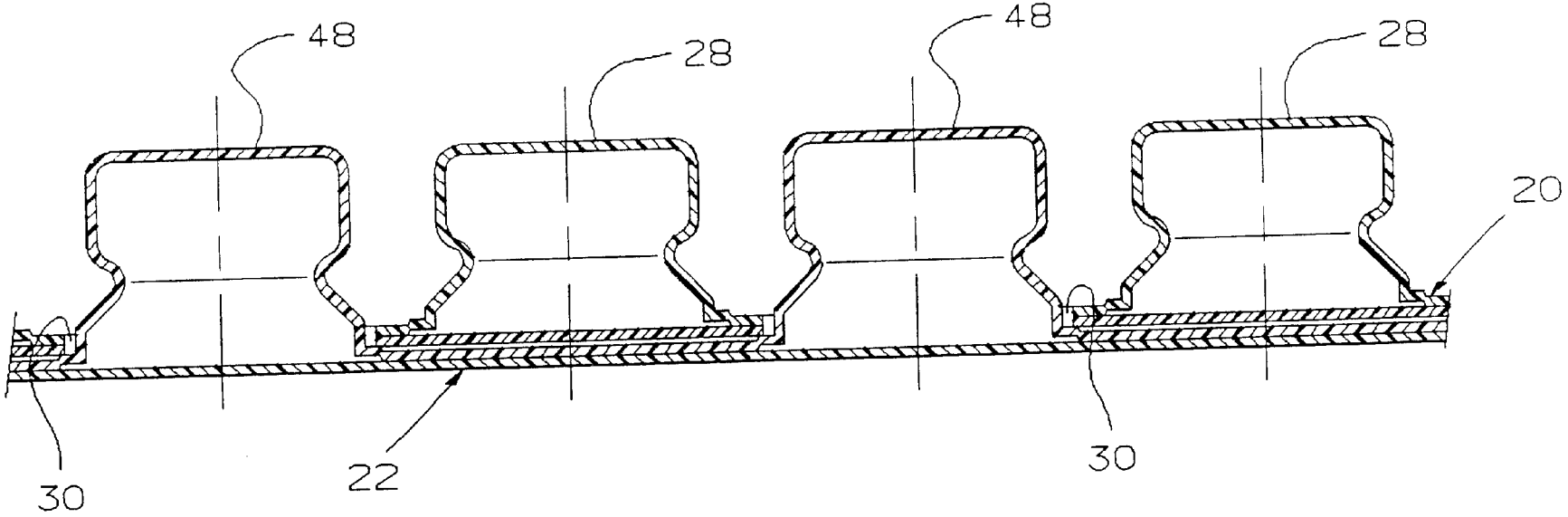
FIG. 9 is a partial cross-sectional view of the assembled mattress matrix assembly.
Figure 10:
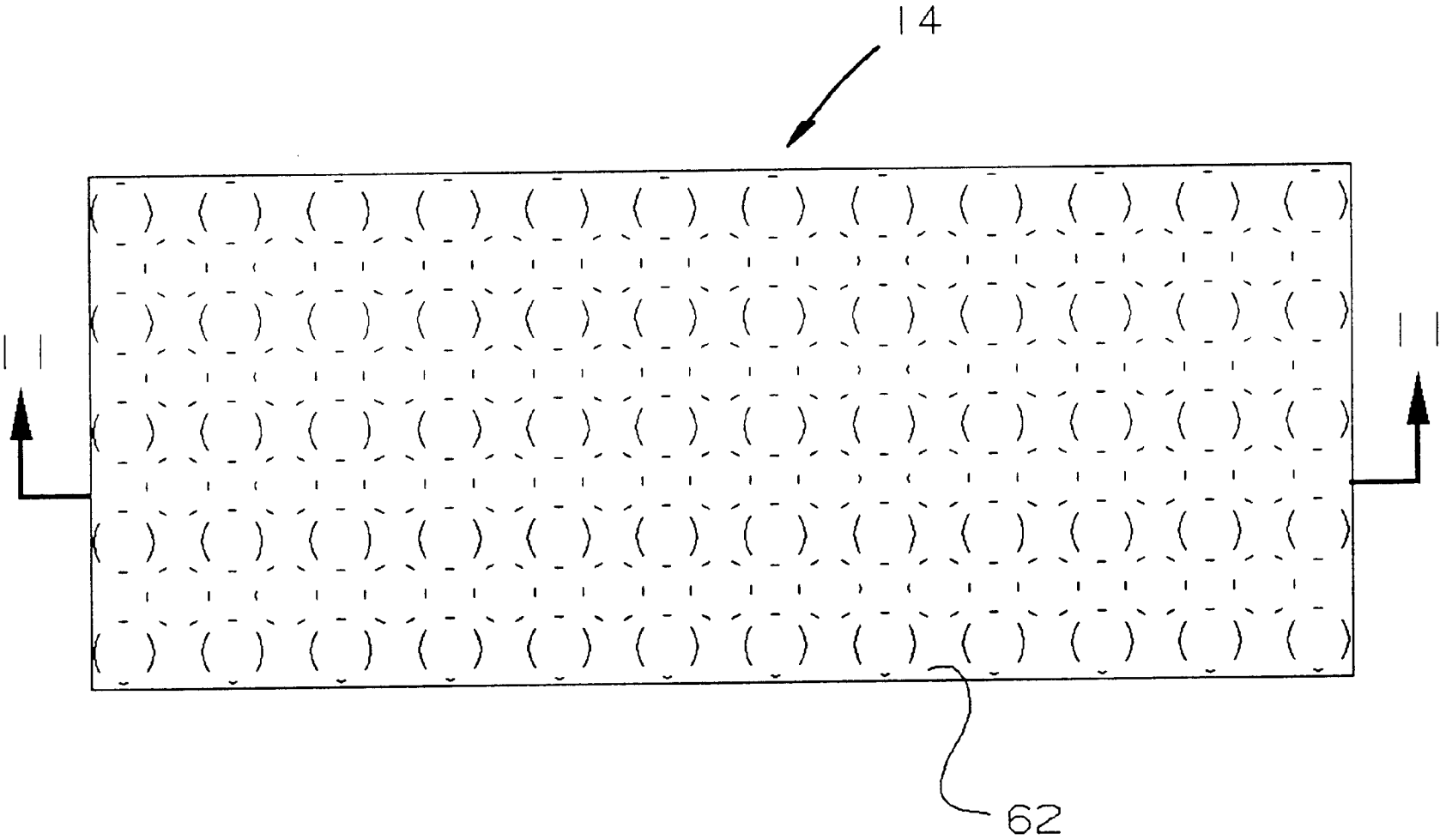
FIG. 10 is a top plan view of the box spring assembly of the present invention air spring bedding system.

Referring to FIGS. 2, 5 and 9, the plurality of apertures 30 are sized to fit a respective one of the plurality of mushroom shaped air springs 48 of the second air support structure 22. The second air support structure 22 is assembled below the first air support structure 20 such that a respective one of the plurality of mushroom shaped air springs 48 of the second air support structure 22 are aligned with and correspond to a respective one of the plurality of apertures 30 of the first air support structure 20. The mushroom shaped air springs 48 of the second air support structure 22 are respectively inserted upwardly into the plurality of apertures 30 of the first air support structure 20, such that the top layer 44 of the second air support structure 22 abuts against the bottom layer 26 of the first air support structure 20, and thereby forms a matrix arrangement of plurality of mushroom shaped air springs (rows and columns). The mushroom shaped air springs 28 of the first air support structure 20 and the mushroom shaped air springs 48 of the second air support structure 22 are relatively close together to prevent lateral movements of the air springs of the first and second air support structures 20 and 22 (see FIG. 9).

When a human body rests on top of the mattress matrix assembly 12, pressure is exerted on compressed mushroom shaped air springs 28 and 48 of the first and second air support structures 20 and 22. Where the force is heaviest, such as the buttock of the human body, air under pressure is transferred from the compressed air springs to lesser compressed air springs. The difference in pressure between the air springs of the first and second air support structures 20 and 22 creates portions of the mattress matrix assembly 12 that are pliable with minimal surface tension between supportive portions. The stress (pressure over area, P/A) produced is reduced because the pliable portions can conform to the complex curves of the human form and thus increase the area (A) supported. Stress concentrations are reduced due to the increase in area supported, overall reduction in supportive pressures and minimized surface tension.

Comfort is created by the ability of the mattress matrix assembly 12 to adjust the relative pressure over a large range to suit the various shapes and masses of resting bodies. Also inherent in the mattress matrix assembly's basic design is the ability to dynamically adapt to a variety of changing resting positions by the proper sizing of the same interconnection of air springs required for pressurization a zone or the entire structure.

Referring to FIGS. 10, 11, 12, and 13, there is shown the box spring assembly 14 which includes an upper airtight and fluid-tight support structure 62 and a lower airtight and fluid-tight support structure 64. The upper and lower airtight support structures 62 and 64 are generally rectangular shaped and have the same dimensions as the first and second air support structures of the mattress matrix assembly of the present invention air spring bedding system.

Figure 11:
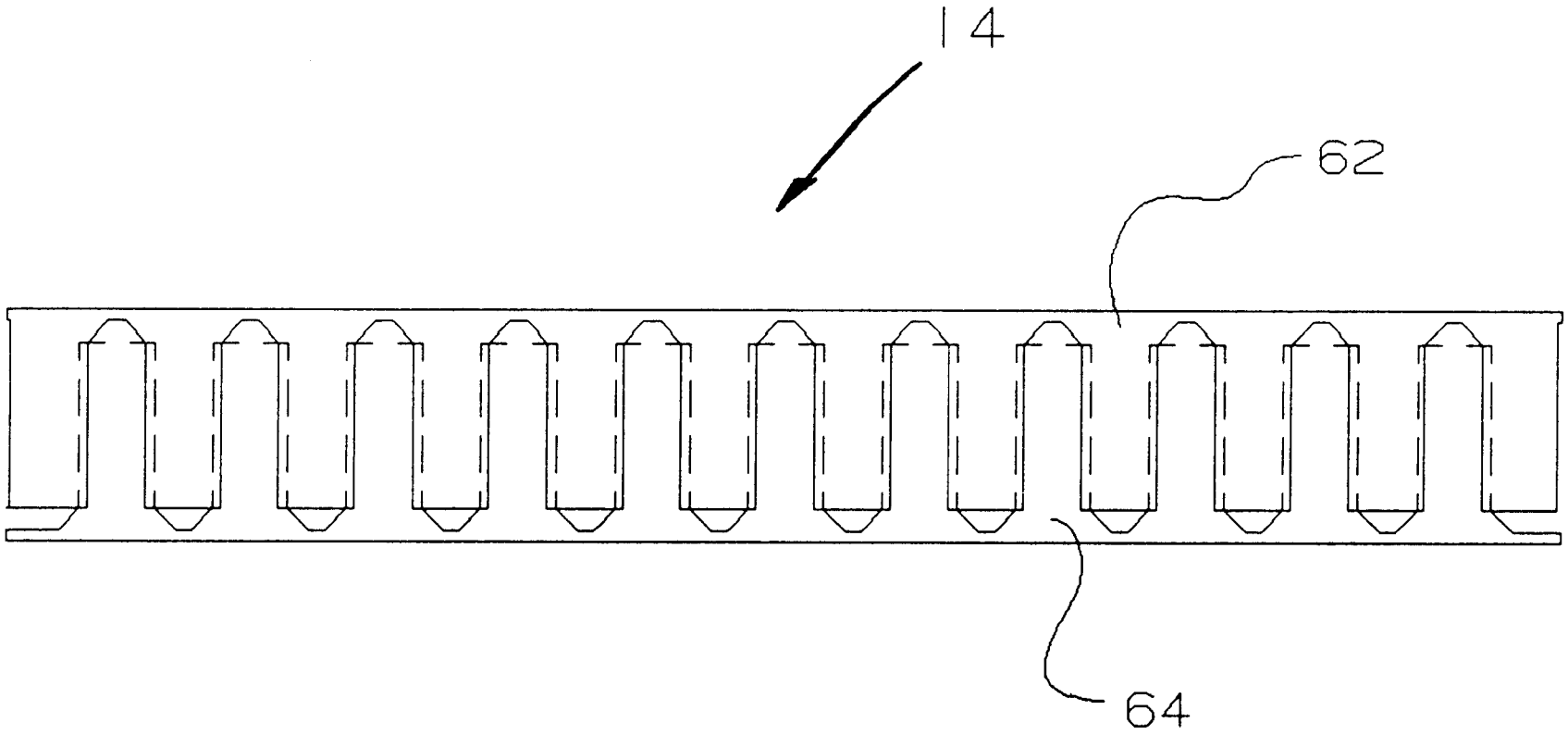
FIG. 11 is a cross-sectional view taken along line 11—11 of FIG. 10.
Figure 12:
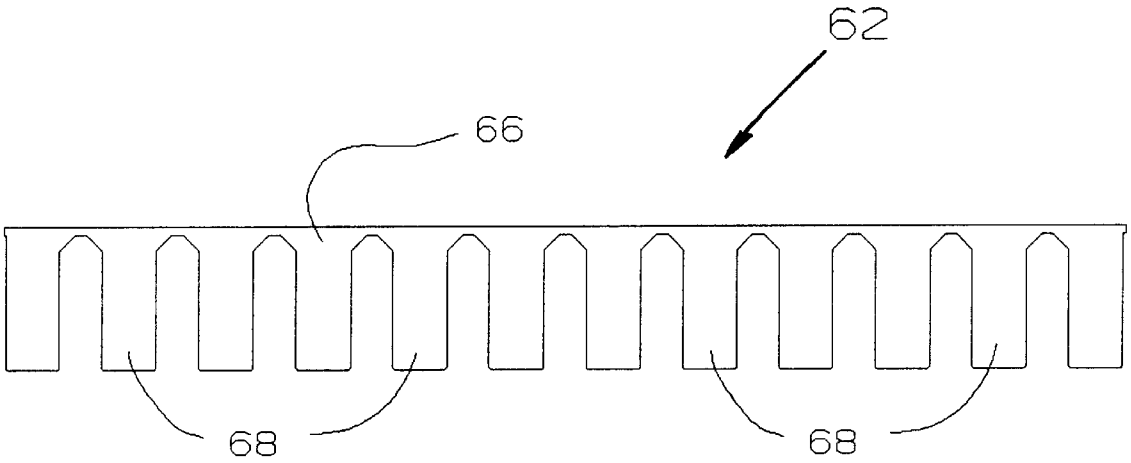
FIG. 12 is a side elevational view of an upper support structure of the box spring assembly of the present invention air spring bedding system.

Referring to FIGS. 11 and 12, the upper airtight and fluid-tight support structure 62 includes a horizontal upper plenum or chamber 66 and a plurality of spaced apart vertical hollow cylinders 68 which extend downwardly from and communicate with the upper plenum 66. These hollow cylinders 68 are arranged in a matrix arrangement (rows and columns).

Figure 13:
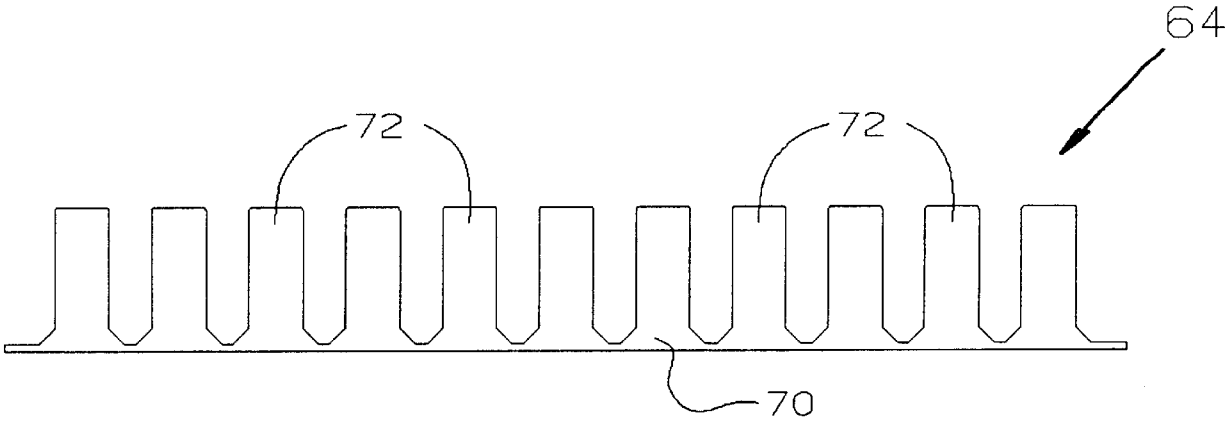
FIG. 13 is a side elevational view of an lower support structure of the box spring assembly of the present invention air spring bedding system.

Referring to FIGS. 11 and 13, the lower airtight and fluid-tight support structure 64 includes a horizontal lower plenum or chamber 70 and a plurality of spaced apart vertical hollow cylinders 72 which extend upwardly from and communicate with the lower plenum 70. These hollow cylinders 72 are also arranged in a matrix arrangement (rows and columns) but are offset from the hollow cylinders 68 of the upper support structure 62.

Referring to FIGS. 10, 11, 12, and 13, the plurality of hollow cylinders 68 of the upper support structure 62 are respectively inserted in-between the plurality of hollow cylinders 72 of the lower support structure 64 such that the plurality of hollow cylinders 68 and 72 of the upper and lower support structures 62 and 64 located adjacent to one another (see FIG. 11).

To fill the upper and lower airtight and fluid-tight support structures 62 and 64 of box spring assembly 14, air, or the like, is adapted to be supplied to the upper and lower support structures 62 and 64 by tubes (not shown), which are secured at one end in communication with the interior of the upper and lower support structures 62 and 64, and which has a conventional valve, which operates in known manner to control the flow of gas into or out of the upper and lower support structures 62 and 64. When the upper plenum 66 of the upper support structure 62 is compressed, the air flows from the upper plenum 66 to the plurality of hollow cylinders 68, while air flows from the plurality of hollow cylinders 72 to the lower plenum 70 of the lower support structure 64.

Referring to FIG. 1, the mattress matrix assembly 12 is positioned on top of the box spring assembly 14, thereby forming the present invention present air spring bedding system 10. The air spring bedding system 10 conforms to conventional forms of manufacture, or any other conventional way known to one skilled in the art. The elements of the present invention air spring bedding system 10 can be made from several materials. The manufacturing process which could accommodate the construction of the present invention bedding system may be injection, thermoform, etc. or other molding process. By way of example, the first and second air support structures 20 and 22 of the mattress matrix assembly 12, and the upper and lower support structures 62 and 64 of the box spring assembly 14 can be made from urethane material, vinyl material or any other suitable material.

It will be appreciated that the mattress matrix assembly 12 may be manufactured as a topper which is known in the bed industry. Using the teachings of the present invention, the topper may be manufactured according to the present invention.

Defined in detail, the present invention is a bedding system, comprising: (a) a generally rectangular shaped box spring assembly including an upper airtight support structure and a lower airtight support structure, the upper support structure having a horizontal upper plenum and a plurality of spaced apart vertical hollow cylinders extending downwardly from and communicating with the horizontal upper plenum and arranged in rows and columns, the lower support structure having a horizontal lower plenum and a plurality of spaced apart vertical hollow cylinders extending upwardly from and communicating with the horizontal lower plenum and arranged in rows and column offset from the plurality of vertical hollow cylinders of the upper support structure; (b) the plurality of hollow cylinders of the upper support structure respectively inserted in-between the plurality of hollow cylinders of the lower support structure such that each of the plurality of hollow cylinders of the upper support structure is located adjacent to one or more of the hollow cylinders and the lower support structure; (c) means for supplying air under pressure to the interiors of the upper and lower support structures; (d) a generally rectangular shaped mattress matrix assembly including a first air support structure and a second air support structure, and being positioned on top of the box spring assembly; (e) the first air support structure having a flexible top layer and a flexible bottom layer affixed to the top layer to form a plurality of spaced apart vertical hollow adjustable mushroom shaped air springs and a plurality of spaced apart apertures extending through from the top layer to the bottom layer, each air spring being compressible and expandable and having a widened open proximal end integrally formed with the top layer, a narrow middle, and a widened closed distal end, the plurality of vertical mushroom shaped air springs and the plurality of spaced apart apertures arranged in an alternating offset from one another; (f) a first group of a plurality of connecting tubes integrally formed with the top layer of the first air support structure, each connecting tube respectively interconnected to two adjacent mushroom shaped air springs; (g) the second air support structure having a flexible top layer and a flexible bottom layer affixed to the top layer to form a plurality of spaced apart vertical hollow adjustable mushroom shaped air springs, each air spring being compressible and expandable and having a widened open proximal end integrally formed with the top layer, a narrow middle, and a widened closed distal end, the plurality of vertical mushroom shaped air springs arranged in an alternating offset from one another and respectively corresponding with the plurality of apertures of the first air support structure respectively; (h) a second group of a plurality of connecting tubes integrally formed with the top layer of the second air support structure, each connecting tube respectively interconnected to two adjacent mushroom shaped air springs of the second air support structure; (i) the second air support structure assembled with the first air support structure, such that the top layer of the second air support structure abuts against the bottom layer of the first air support structure, where a respective one of the plurality of adjustable mushroom shaped air springs of the second air support structure are respectively inserted upwardly into a respective one of the plurality of apertures of the first air support structure, and thereby form in a matrix arrangement; and (j) means for supplying air under pressure to inflate the plurality of adjustable mushroom shaped air springs of the first and second air support structures to a desired stiffness, such that the plurality of mushroom shaped air springs of the first and second air support structures are relatively close together and air is respectively transferrable from the plurality of mushroom shaped air springs by the first and second groups of the plurality of connecting tubes; (k) whereby the mattress matrix assembly has the ability to adjust the relative pressure over a large range to suit the various shapes and masses of resting bodies.

Defined broadly, the present invention is a bedding system, comprising: (a) a box spring assembly including a first airtight body and a second airtight body, the first airtight body having a plenum and a plurality of spaced apart hollow cylinders extending from and communicating with the plenum, the second airtight structure having a plenum and a plurality of spaced apart hollow cylinders extending from and communicating with the plenum and offset from the plurality of hollow cylinders of the first airtight structure; (b) the plurality of hollow cylinders of the first airtight structure respectively inserted in between the plurality of hollow cylinders of the second structure such that each of the plurality of hollow cylinders of the first airtight structure is located adjacent to at least one hollow cylinder of the second airtight structure; (c) means for supplying air under pressure to the interiors of the first and second airtight structures; (d) a mattress matrix assembly including a first air structure and a second air structure, and being positioned on top of the box spring assembly; (e) the first air structure having a generally flat base portion, a plurality of spaced apart hollow adjustable mushroom shaped air springs extending upwardly from the base portion, and a plurality of spaced apart apertures extending therethrough from the base portion, the plurality of hollow adjustable mushroom shaped air springs and the plurality of spaced apart apertures arranged in an alternating offset arrangement from one another; (f) a first group of a plurality of connecting tubes formed with the base portion of the first air structure, each connecting tube respectively interconnected to a pair of adjacent mushroom shaped air springs; (g) the second air structure having a generally flat base portion and a plurality of spaced apart hollow adjustable mushroom shaped air springs extending upwardly from the base portion, the plurality of mushroom shaped air springs arranged in an alternating offset arrangement from one another and respectively corresponding with the plurality of apertures of the first air structure respectively; (h) a second group of a plurality of connecting tubes formed with the base portion of the second air structure, each connecting tube respectively interconnected to a pair of adjacent mushroom shaped air springs of the second air structure; (i) a respective one of the plurality of adjustable mushroom shaped air springs of the second air structure respectively inserted upwardly through a respective one of the plurality of apertures of the first air structure, such that the base portion of the first air structure abuts against the base portion of the second air structure, where the plurality of adjustable mushroom shaped air springs of the first and second air structures are arranged in a matrix arrangement; and () means for supplying air under pressure to inflate the plurality of adjustable mushroom shaped air springs of the first and second structures to a desired stiffness, such that the plurality of mushroom shaped air springs of the first and second air structures are relatively close together and air is respectively transferrable from the plurality of mushroom shaped air springs by the first and second groups of the plurality of connecting tubes; (k) whereby the mattress matrix assembly has the ability to adjust the relative pressure over a large range to suit the various shapes and masses of resting bodies.

Defined more broadly, the present invention is a bedding system, comprising: (a) a first body having a plenum and a plurality of compressible members extending from the plenum; (b) a second body having a plenum and a plurality of compressible members extending from the plenum and offset from the plurality of compressible members of the first body, such that each of the plurality of compressible members of the second body are respectively inserted in-between respective groups of the plurality of compressible members of the first body; (c) means for supplying air under pressure to inflate the first and second bodies; (d) a first air structure having a base and a plurality of alternating offset compressible and expandable members extending upwardly from the base, and a plurality of apertures respectively located between the plurality of alternating offset compressible and expandable members and extending therethrough from the base; (e) a first group of a plurality of connecting members, each connecting member respectively connected to a pair of adjacent compressible and expandable members; (f) a second air structure having base and a plurality of alternating offset compressible and expandable members extending upwardly from the base; (g) a second group of a plurality of connecting members, each connecting member respectively connected to a pair of adjacent compressible and expandable members of the second air structure; and (h) a respective one of the plurality of alternating offset compressible and expandable members of the second air structure respectively inserted into a respective one of the plurality of apertures of the first air structure, such that the base of the of the first air structure abuts against the base of the second air structure, where the plurality of alternating offset compressible and expandable members of the first and second air structures are located relatively close together and air is respectively transferrable from the plurality of alternating offset compressible and expandable members by the first and second groups of the plurality of connecting members; (i) whereby the first and second air structures have the ability to adjust the relative pressure over a large range to suit the various shapes and masses of resting bodies.

Alternatively defined in detail, the present invention is a mattress, comprising: (a) a first air support structure having a flexible top layer and a flexible bottom layer affixed to the top layer to form a plurality of spaced apart vertical hollow adjustable mushroom shaped air springs and a plurality of spaced apart apertures extending through from the top layer to the bottom layer, each air spring being compressible and expandable and having a widened open proximal end integrally formed with the top layer, a narrow middle, and a widened closed distal end, the plurality of vertical mushroom shaped air springs and the plurality of spaced apart apertures arranged in an alternating offset from one another; (b) a first group of a plurality of connecting tubes integrally formed with the top layer of the first air support structure, each connecting tube respectively interconnected to two adjacent mushroom shaped air springs; (c) a second air support structure having a flexible top layer and a flexible bottom layer affixed to the top layer to form a plurality of spaced apart vertical hollow adjustable mushroom shaped air springs, each air spring being compressible and expandable and having a widened open proximal end integrally formed with the top layer, a narrow middle, and a widened closed distal end, the plurality of vertical mushroom shaped air springs arranged in an alternating offset from one another and a respective one of the vertical mushroom shaped air springs corresponding with a respective one of the plurality of apertures of the first air support structure; (d) a second group of a plurality of connecting tubes integrally formed with the top layer of the second air support structure, each connecting tube respectively interconnected to two adjacent mushroom shaped air springs of the second air support structure; (e) the second air support structure assembled with the first air support structure, such that the top layer of the second air support structure abuts against the bottom layer of the first air support structure, where a respective one of the plurality of adjustable mushroom shaped air springs of the second air support structure are respectively inserted upwardly into a respective one of the plurality of apertures of the first air support structure, and thereby form a matrix arrangement; and (f) means for supplying air under pressure to inflate the plurality of adjustable mushroom shaped air springs of the first and second air support structures to a desired stiffness, such that the plurality of mushroom shaped air springs of the first and second air support structures are relatively close together and air is respectively transferrable from the plurality of mushroom shaped air springs by the first and second groups of the plurality of connecting tubes; (g) whereby the first and second air support structures have the ability to adjust the relative pressure over a large range to suit the various shapes and masses of resting bodies.

Alternatively defined broadly, the present invention is a mattress, comprising: (a) a first air structure having a generally flat base portion, a plurality of spaced apart hollow adjustable mushroom shaped air springs extending upwardly from the base portion, and a plurality of spaced apart apertures extending through the base portion, the plurality of hollow adjustable mushroom shaped air springs and the plurality of spaced apart apertures arranged in an alternating offset arrangement from one another; (b) a first group of a plurality of connecting tubes formed with the base portion of the first air structure, each connecting tube respectively interconnected to a pair of adjacent mushroom shaped air springs; (c) a second air structure having a generally flat base portion and a plurality of spaced apart hollow adjustable mushroom shaped air springs extending upwardly from the base portion, the plurality of mushroom shaped air springs arranged in an alternating offset arrangement from one another and a respective one of the mushroom shaped air springs corresponding with a respective one of the plurality of apertures of the first air structure; (d) a second group of a plurality of connecting tubes formed with the base portion of the second air structure, each connecting tube respectively interconnected to a pair of adjacent mushroom shaped air springs of the second air structure; (e) a respective one of the plurality of adjustable mushroom shaped air springs of the second air structure respectively inserted upwardly into a respective one of the plurality of apertures of the first air structure, such that the base portion of the second air structure abuts against the base portion of the first air structure, where the plurality of adjustable mushroom shaped air springs of the first and second air structures are arranged in a matrix arrangement; and (f) means for supplying air under pressure to inflate the plurality of adjustable mushroom shaped air springs of the first and second structures to a desired stiffness, such that the plurality of mushroom shaped air springs of the first and second air structures are relatively close together and air is respectively transferrable from the plurality of mushroom shaped air springs by the first and second groups of the plurality of connecting tubes; (g) whereby the first and second air structures have the ability to adjust the relative pressure over a large range to suit the various shapes and masses of resting bodies.

Alternatively defined more broadly, the present invention is a mattress, comprising: (a) a first air structure having a base and a plurality of alternating offset compressible and expandable members extending upwardly from the base, and a plurality of apertures respectively located between the plurality of alternating offset compressible and expandable members and extending through from the base; (b) a first group of a plurality of connecting members, each connecting member respectively connected to a pair of adjacent compressible and expandable members; (c) a second air structure having base and a plurality of alternating offset compressible and expandable members extending upwardly from the base; (d) a second group of a plurality of connecting members, each connecting member respectively connected to a pair of adjacent compressible and expandable members of the second air structure; and (e) a respective one of the plurality of alternating offset compressible and expandable members of the second air structure respectively inserted into a respective one of the plurality of apertures of the first air structure, such that the plurality of alternating offset compressible and expandable of the first and second airtight structures are located relatively close together and air is respectively transferrable from the plurality of alternating offset compressible and expandable members by the first and second groups of the plurality of connecting members; (f) whereby the first and second air structures have the ability to adjust the relative pressure over a large range to suit the various shapes and masses of resting bodies.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A bedding system, comprising:

a. a generally rectangular shaped box spring assembly including an upper airtight support structure and a lower airtight support structure, the upper support structure having a horizontal upper plenum and a plurality of spaced apart vertical hollow cylinders extending downwardly from and communicating with the horizontal upper plenum and arranged in rows and columns, the lower support structure having a horizontal lower plenum and a plurality of spaced apart vertical hollow cylinders extending upwardly from and communicating with the horizontal lower plenum and arranged in rows and column offset from the plurality of vertical hollow cylinders of the upper support structure;

b. said plurality of hollow cylinders of said upper support structure respectively inserted in-between said plurality of hollow cylinders of said lower support structure such that each of said plurality of hollow cylinders of said upper support structure is located adjacent to one or more of the hollow cylinders of the lower support structure;

c. means for supplying air under pressure to the interiors of said upper and lower support structures;

d. a generally rectangular shaped mattress matrix assembly including a first air support structure and a second air support structure, and being positioned on top of said box spring assembly;

e. said first air support structure having a flexible top layer and a flexible bottom layer affixed to the top layer to form a plurality of spaced apart vertical hollow adjustable mushroom shaped air springs and a plurality of spaced apart apertures extending through from the top layer to the bottom layer, each air spring being compressible and expandable and having a widened open proximal end integrally formed with the top layer, a narrow middle, and a widened closed distal end, the plurality of vertical mushroom shaped air springs and the plurality of spaced apart apertures arranged in an alternating offset from one another;

f. a first group of a plurality of connecting tubes integrally formed with said top layer of said first air support structure, each connecting tube respectively interconnected to two adjacent mushroom shaped air springs;

g. said second air support structure having a flexible top layer and a flexible bottom layer affixed to the top layer to form a plurality of spaced apart vertical hollow adjustable mushroom shaped air springs, each air spring being compressible and expandable and having a widened open proximal end integrally formed with the top layer, a narrow middle, and a widened closed distal end, the plurality of vertical mushroom shaped air springs arranged in an alternating offset from one another and respectively corresponding with said plurality of apertures of said first air support structure respectively;

h. a second group of a plurality of connecting tubes integrally formed with said top layer of said second air support structure, each connecting tube respectively interconnected to two adjacent mushroom shaped air springs of said second air support structure;

i. said second air support structure assembled with said first air support structure, such that said top layer of said second air support structure abuts against said bottom layer of said first air support structure, where a respective one of said plurality of adjustable mushroom shaped air springs of said second air support structure are respectively inserted upwardly into a respective one of said plurality of apertures of said first air support structure, and thereby form in a matrix arrangement; and j. means for supplying air under pressure to inflate said plurality of adjustable mushroom shaped air springs of said first and second air support structures to a desired stiffness, such that said plurality of mushroom shaped air springs of said first and second air support structures are relatively close together and air is respectively transferrable from said plurality of mushroom shaped air springs by said first and second groups of said plurality of connecting tubes;

k. whereby said mattress matrix assembly has the ability to adjust the relative pressure over a large range to suit the various shapes and masses of resting bodies.

2. The bedding system in accordance with claim 1 further comprising a mattress cover for covering said first and second air support structures of said mattress matrix assembly.

3. The bedding system in accordance with claim 1 further comprising a box spring cover for covering said upper and lower airtight support structures of said box spring assembly.

4. The bedding system in accordance with claim 1 wherein said first and second air support structures of said mattress matrix assembly are made from vinyl material.

5. The bedding system in accordance with claim 1 wherein said first and second air support structures of said mattress matrix assembly are made from urethane material.

6. The bedding system in accordance with claim 1 wherein said means for supplying air under pressure includes a main inlet port integrally formed with said top layers of said first and second air support structures of said mattress matrix assembly.

7. A bedding system, comprising:

a. a box spring assembly including a first airtight body and a second airtight body, the first airtight body having a plenum and a plurality of spaced apart hollow cylinders extending from and communicating with the plenum, the second airtight structure having a plenum and a plurality of spaced apart hollow cylinders extending from and communicating with the plenum and offset from the plurality of hollow cylinders of the first airtight structure;

b. said plurality of hollow cylinders of said first airtight structure respectively inserted in-between said plurality of hollow cylinders of said second structure such that each of said plurality of hollow cylinders of said first air tight structure is located adjacent to at least one hollow cylinder of the second airtight structure;

c. means for supplying air under pressure to the interiors of said first and second airtight structures;

d. a mattress matrix assembly including a first air structure and a second air structure, and being positioned on top of said box spring assembly;

e. said first air structure having a generally flat base portion, a plurality of spaced apart hollow adjustable mushroom shaped air springs extending upwardly from the base portion, and a plurality of spaced apart apertures extending therethrough from the base portion, the plurality of hollow adjustable mushroom shaped air springs and the plurality of spaced apart apertures arranged in an alternating offset arrangement from one another;

f. a first group of a plurality of connecting tubes formed with said base portion of said first air structure, each connecting tube respectively interconnected to a pair of adjacent mushroom shaped air springs;

g. said second air structure having a generally flat base portion and a plurality of spaced apart hollow adjustable mushroom shaped air springs extending upwardly from the base portion, the plurality of mushroom shaped air springs arranged in an alternating offset arrangement from one another and respectively corresponding with said plurality of apertures of said first air structure respectively;

h. a second group of a plurality of connecting tubes formed with said base portion of said second air structure, each connecting tube respectively interconnected to a pair of adjacent mushroom shaped air springs of said second air structure;

i. a respective one of said plurality of adjustable mushroom shaped air springs of said second air structure respectively inserted upwardly through a respective one of said plurality of apertures of said first air structure, such that said base portion of said first air structure abuts against the base portion of said second air structure, where said plurality of adjustable mushroom shaped air springs of said first and second air structures are arranged in a matrix arrangement; and j. means for supplying air under pressure to inflate said plurality of adjustable mushroom shaped air springs of said first and second structures to a desired stiffness, such that said plurality of mushroom shaped air springs of said first and second air structures are relatively close together and air is respectively transferrable from said plurality of mushroom shaped air springs by said first and second groups of said plurality of connecting tubes;

k. whereby said mattress matrix assembly has the ability to adjust the relative pressure over a large range to suit the various shapes and masses of resting bodies.

8. The bedding system in accordance with claim 7 further comprising a mattress cover for covering said first and second air structures of said mattress matrix assembly.

9. The bedding system in accordance with claim 7 further comprising a box spring cover for covering said first and second airtight structures of said box spring assembly.

10. The bedding system in accordance with claim 7 wherein said first and second air structures of said mattress matrix assembly are made from vinyl material.

11. The bedding system in accordance with claim 7 wherein said first and second air structures of said mattress matrix assembly are made from urethane material.

12. The bedding system in accordance with claim 7 wherein said means for supplying air under pressure includes a main inlet port formed with said base portions of said first and second air structures of said mattress matrix assembly.

13. A bedding system, comprising:

a. a first body having a plenum and a plurality of compressible members extending from the plenum;

b. a second body having a plenum and a plurality of compressible members extending from the plenum and offset from said plurality of compressible members of said first body, such that each of the plurality of compressible members of the second body are respectively inserted in-between respective groups of said plurality of compressible members of said first body;

c. means for supplying air under pressure to inflate said first and second bodies;

d. a first air structure having a base and a plurality of alternating offset compressible and expandable members extending upwardly from the base, and a plurality of apertures respectively located between the plurality of alternating offset compressible and expandable members and extending therethrough from the base;

e. a first group of a plurality of connecting members, each connecting member respectively connected to a pair of adjacent compressible and expandable members;

f. a second air structure having base and a plurality of alternating offset compressible and expandable members extending upwardly from the base;

g. a second group of a plurality of connecting members, each connecting member respectively connected to a pair of adjacent compressible and expandable members of said second air structure; and h. a respective one of said plurality of alternating offset compressible and expandable members of said second air structure respectively inserted into a respective one of said plurality of apertures of said first air structure, such that said base of said of said first air structure abuts against said base of said second air structure, where said plurality of alternating offset compressible and expandable members of said first and second air structures are located relatively close together and air is respectively transferrable from said plurality of alternating offset compressible and expandable members by said first and second groups of said plurality of connecting members;

i. whereby said first and second air structures have the ability to adjust the relative pressure over a large range to suit the various shapes and masses of resting bodies.

14. The bedding system in accordance with claim 13 further comprising a cover for covering said first and second air structures.

15. The bedding system in accordance with claim 13 wherein said first and second air structures are made from plastic material.

16. The bedding system in accordance with claim 13 wherein each of said plurality of alternating offset compressible and expandable members of said first and second air structures are of a generally vertical hollow mushroom shape.

17. The bedding system in accordance with claim 13 wherein said means for supplying air under pressure includes a main inlet port.

18. A mattress, comprising:

a. a first air support structure having a flexible top layer and a flexible bottom layer affixed to the top layer to form a plurality of spaced apart vertical hollow adjustable mushroom shaped air springs and a plurality of spaced apart apertures extending through from the top layer to the bottom layer, each air spring being compressible and expandable and having a widened open proximal end integrally formed with the top layer, a narrow middle, and a widened closed distal end, the plurality of vertical mushroom shaped air springs and the plurality of spaced apart apertures arranged in an alternating offset from one another;

b. a first group of a plurality of connecting tubes integrally formed with said top layer of said first air support structure, each connecting tube respectively interconnected to two adjacent mushroom shaped air springs;

c. a second air support structure having a flexible top layer and a flexible bottom layer affixed to the top layer to form a plurality of spaced apart vertical hollow adjustable mushroom shaped air springs, each air spring being compressible and expandable and having a widened open proximal end integrally formed with the top layer, a narrow middle, and a widened closed distal end, the plurality of vertical mushroom shaped air springs arranged in an alternating offset from one another and a respective one of the vertical mushroom shaped air springs corresponding with a respective one of said plurality of apertures of said first air support structure;

d. a second group of a plurality of connecting tubes integrally formed with said top layer of said second air support structure, each connecting tube respectively interconnected to two adjacent mushroom shaped air springs of said second air support structure;

e. said second air support structure assembled with said first air support structure, such that said top layer of said second air support structure abuts against said bottom layer of said first air support structure, where a respective one of said plurality of adjustable mushroom shaped air springs of said second air support structure are respectively inserted upwardly into a respective one of said plurality of apertures of said first air support structure, and thereby form a matrix arrangement; and f. means for supplying air under pressure to inflate said plurality of adjustable mushroom shaped air springs of said first and second air support structures to a desired stiffness, such that said plurality of mushroom shaped air springs of said first and second air support structures are relatively close together and air is respectively transferrable from said plurality of mushroom shaped air springs by said first and second groups of said plurality of connecting tubes;

g. whereby said first and second air support structures have the ability to adjust the relative pressure over a large range to suit the various shapes and masses of resting bodies.

19. The mattress in accordance with claim 18 further comprising a mattress cover for covering said first and second air support structures.

20. The mattress in accordance with claim 18 wherein said first and second air support structures are made from vinyl material.

21. The mattress in accordance with claim 18 wherein said first and second air support structures are made from urethane material.

22. The mattress in accordance with claim 18 wherein said means for supplying air under pressure includes a main inlet port integrally formed with said top layers of said first and second air support structures.

23. A mattress, comprising:

a. a first air structure having a generally flat base portion, a plurality of spaced apart hollow adjustable mushroom shaped air springs extending upwardly from the base portion, and a plurality of spaced apart apertures extending through the base portion, the plurality of hollow adjustable mushroom shaped air springs and the plurality of spaced apart apertures arranged in an alternating offset arrangement from one another;

b. a first group of a plurality of connecting tubes formed with said base portion of said first air structure, each connecting tube respectively interconnected to a pair of adjacent mushroom shaped air springs;

c. a second air structure having a generally flat base portion and a plurality of spaced apart hollow adjustable mushroom shaped air springs extending upwardly from the base portion, the plurality of mushroom shaped air springs arranged in an alternating offset arrangement from one another, and a respective one of the mushroom shaped air springs corresponding with a respective one of said plurality of apertures of said first air structure;

d. a second group of a plurality of connecting tubes formed with said base portion of said second air structure, each connecting tube respectively interconnected to a pair of adjacent mushroom shaped air springs of said second air structure;

e. a respective one of said plurality of adjustable mushroom shaped air springs of said second air structure respectively inserted upwardly into a respective one of said plurality of apertures of said first air structure, such that said base portion of said second air structure abuts against said base portion of said first air structure, where said plurality of adjustable mushroom shaped air springs of said first and second air structures are arranged in a matrix arrangement; and f. means for supplying air under pressure to inflate said plurality of adjustable mushroom shaped air springs of said first and second structures to a desired stiffness, such that said plurality of mushroom shaped air springs of said first and second air structures are relatively close together and air is respectively transferrable from said plurality of mushroom shaped air springs by said first and second groups of said plurality of connecting tubes;

g. whereby said first and second air structures have the ability to adjust the relative pressure over a large range to suit the various shapes and masses of resting bodies.

24. The mattress in accordance with claim 23 further comprising a mattress cover for covering said first and second air structures.

25. The mattress in accordance with claim 23 wherein said first and second air structures are made from vinyl material.

26. The mattress in accordance with claim 23 wherein said first and second air structures are made from urethane material.

27. The mattress in accordance with claim 23 wherein said means for supplying air under pressure includes a main inlet port formed with said base portions of said first and second air structures.

28. A mattress, comprising:

a. a first air structure having a base and a plurality of alternating offset compressible and expandable members extending upwardly from the base, and a plurality of apertures respectively located between the plurality of alternating offset compressible and expandable members and extending through from the base;

b. a first group of a plurality of connecting members, each connecting member respectively connected to a pair of adjacent compressible and expandable members;

c. a second air structure having base and a plurality of alternating offset compressible and expandable members extending upwardly from the base;

d. a second group of a plurality of connecting members, each connecting member respectively connected to a pair of adjacent compressible and expandable members of said second air structure; and e. a respective one of said plurality of alternating offset compressible and expandable members of said second air structure respectively inserted into a respective one of said plurality of apertures of said first air structure, such that said plurality of alternating offset compressible and expandable of said first and second airtight structures are located relatively close together and air is respectively transferrable from said plurality of alternating offset compressible and expandable members by said first and second groups of said plurality of connecting members;

f. whereby said first and second air structures have the ability to adjust the relative pressure over a large range to suit the various shapes and masses of resting bodies.

29. The mattress in accordance with claim 28 further comprising a cover for covering said first and second air structures.

30. The mattress in accordance with claim 28 wherein said first and second air structures are made from plastic material.

31. The mattress in accordance with claim 28 wherein each of said plurality of alternating offset compressible and expandable members of said first and second air structures are of a generally vertical hollow mushroom shape.

32. The mattress in accordance with claim 28 wherein said means for supplying air under pressure includes a main inlet port.

* * * * *